United States Patent [19]

Karpisek

[11] 4,067,686

[45] Jan. 10, 1978

[54] NOZZLE

[76] Inventor: Ladislav Stephan Karpisek, 86 Woodfield Blvd., Caringbah, N.S.W., Australia, 2229

[21] Appl. No.: 678,876

[22] Filed: Apr. 21, 1976

[30] Foreign Application Priority Data

Apr. 22, 1975 Australia ..... 1327/75

[51] Int. Cl.[2] ..... A23F 1/00
[52] U.S. Cl. ..... 431/353; 431/354
[58] Field of Search ..... 431/158, 353, 354, 347

[56] References Cited

U.S. PATENT DOCUMENTS

| | | | |
|---|---|---|---|
| 2,807,316 | 9/1957 | Jackson | 431/158 |
| 3,171,465 | 3/1965 | Rydberg | 431/158 |
| 3,385,381 | 5/1968 | Calaman | 431/158 |
| 3,779,694 | 12/1973 | Zagoroff | 431/347 |
| 3,787,169 | 1/1974 | Gjerde | 431/354 |
| 3,804,578 | 4/1974 | Robbins | 431/158 |

*Primary Examiner*—Edward G. Favors
*Attorney, Agent, or Firm*—Emory L. Groff, Jr.

[57] ABSTRACT

This invention provides a flame nozzle of the type which can be used as a burner such as, for example, as a burner on a hand held heating gun for applying heat to an article or it could be used as a burner for a furnace.

5 Claims, 6 Drawing Figures

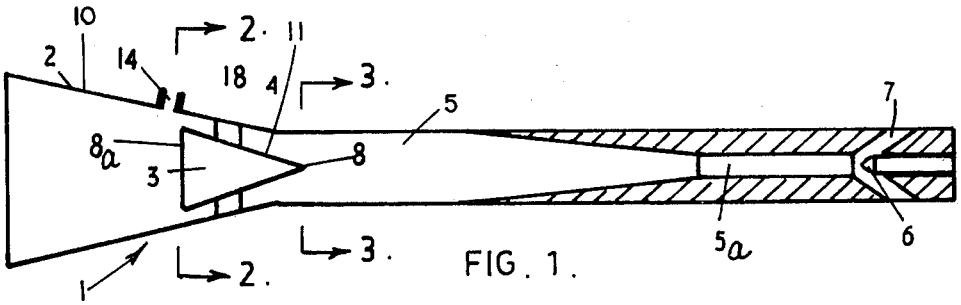
FIG. 1.
FIG. 4.
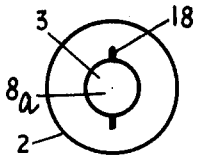
FIG. 3.
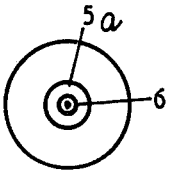
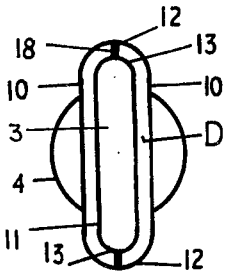
FIG. 2.
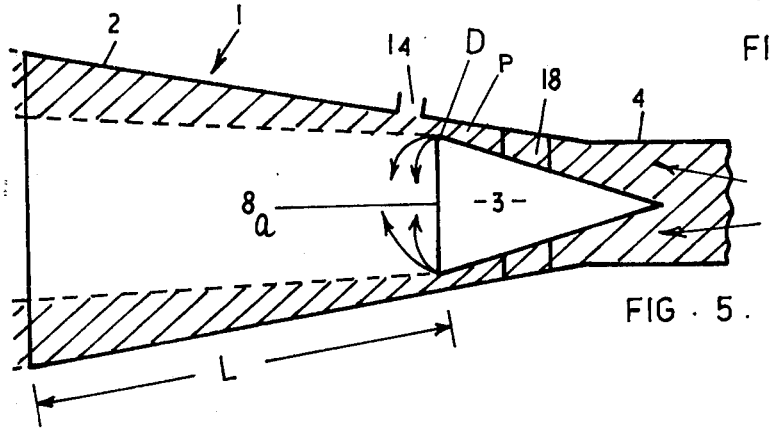
FIG. 5.
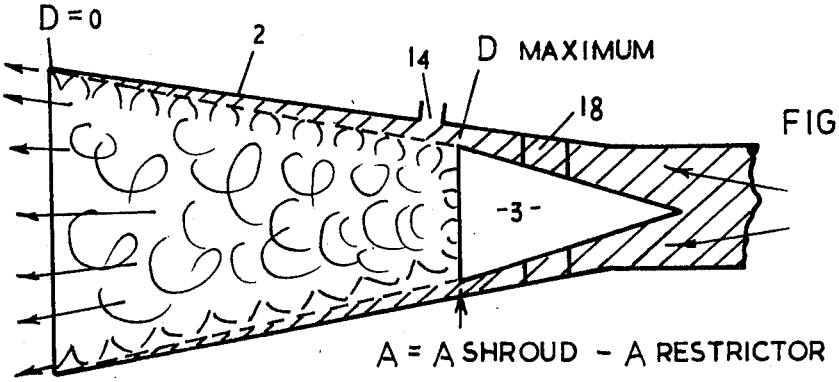
FIG. 6.

NOZZLE

Hitherto it has been the practice to provide a nozzle designed to burn a gaseous fuel at the end of the nozzle, its outlet. Because the flame from such a nozzle is not entrained in a passageway it lacks positive shape at the nozzle outlet, due mainly to free burning at atmospheric pressure without forward velocity, and so flame deflection occurs. It is a very ragged, ill defined and low velocity flame which results from such known nozzles. If, as sometimes happens, the flame begins to burn inside the nozzle, and not at its end, the nozzle body soon becomes overheated. This is natural because, in the case of LPG and air, the combustion temperature within the nozzle is in excess of 3000° F. It has been observed however that burning in the nozzle resulted in the flame, where it leaves the nozzle, being of a better shape and there is a forward flame velocity.

With the foregoing observations in view Applicants have designed a nozzle where burning takes place inside the nozzle, to promote better flame shape and flame velocity, but at the same time a nozzle which will not become hotter in operation than known nozzles where the flame burns at the nozzle outlet. The nozzle of this invention results from the experiments made to achieve the above standards of performance. Additionally by appropriate dimensioning almost complete combustion of the fuel can be achieved.

Generally the nozzle can be said to provide a nozzle in which combustion of gaseous fuel is to take place, said nozzle comprising a tubular shroud part and an interiorly co-axially mounted restrictor part, the shroud at one end is adapted to be coupled to a supply of pressurised gaseous fuel, the restrictor is generally pyramidal or conical in shape with the apex of the pyramid pointing to said one end of said shroud, the shape of the base of the pyramid is similar to the internal cross-sectional shape of the shroud but is smaller so as to provide a gap between the perimeter of the pyramid base and the adjacent interior surface of the shroud through which a generally tubular stream of gaseous fuel passes the linear value of gap D is calculated by the formula $$D = ALF/V_o$$

where $A$ is the area of gap of linear width $D$, $L$ is the length of travel of the gaseous fuel in the nozzle from the point of ignition of the innermost layer of gaseous fuel in the stream to the point where the outermost layer of gaseous fuel ignites, $F$ is the speed of flame propagation and $V_o$ is the volume of gaseous fuel per unit time passing through $A$.

Several embodiments are herein described with reference to the drawings in which:

FIG. 1 is a sectional side view of a typical nozzle as integrated into the barrel of a gun of the type used for heating shrink wrap plastic film, FIG. 2 and FIG. 3 are respectively cross-sectional views on section lines 2—2 and 3—3 of FIG. 1, FIG. 4 is an end view of another embodiment of the invention and FIG. 5 and FIG. 6 are respectively diagrammatic views showing gaseous fuel flow prior to ignition and flame formation in the nozzle during the operation thereof.

Referring to FIG. 1, nozzle 1 comprises a shroud 2 and a restrictor 3. The shroud 2 has a tail part 4 which is coupled to a barrel 5 of a heating gun in which is mounted a venturi 5a by means of which combustible gaseous fuel, comprising gas from a supply (not shown) which is fed through jet 6 and air from intakes 7, is accelerated to a predetermined velocity.

The restrictor 3 is a hollow, open-ended pyramid of generally rectangular cross-section having an apex 8 and an open end 8a directed downstream. In the example illustrated in FIGS. 1 to 3 the shroud 2 and the restrictor 3 both have a pair of parallel sides 10 and 11 (see FIG. 2) respectively joined by arcuate parts 12 and 13 respectively. The angle between sides 10 (for the shroud) is preferably slightly less than the angle between the sides 11 (for the restrictor) and likewise the angle between the sides 12 (of the shroud) is preferably slightly less than the angle between the sides 13 (of the restrictor). The gap D between the shroud and the restrictor is generally uniform in width but can vary for the reasons discussed later. The cross-sectional area of the shroud outlet approximates the cross-sectional area of the tail part 4 adjacent the apex 8 of the restrictor (at section line 3—3).

The restrictor 3 is held in place by wings 18 fixed to the shroud. The wings are as small as possible to prevent turbulence in the mixture passing through the gap.

For practical purposes an igniting opening 14 has been shown adjacent the base of the restrictor. The gas in the nozzle is ignited by placing a flame at the opening 14 and the velocity of gas passing through the nozzle draws the igniting flame placed at the opening 14 into the nozzle. An electric spark generator can also be used with the electrode at the location 14.

The operation of the nozzle is best explained with reference to FIG. 1. Gas at pressure greater than atmospheric is introduced into the venturi from jet 6 and the velocity of gas draws atmospheric air through the appropriately dimensioned air intakes 7 so as to achieve a predetermined gas to air ratio. The gas and air mixture is accelerated through the venturi 5a and issues as a stream of higher velocity. Because of the restriction at the gap D, the cross-sectional area being considerably less than the cross-sectional area of the tail part 4 at section line 3—3 there is a pressure increase in the zone shown P and around the restrictor and downstream to the venturi outlet. The pressure at P is well above atmospheric.

The pressure at P is such that the combustible mixture passes through the gap D at high velocity and the mixture after leaving the gap D loses velocity, generally proportional to the distance from the gap D.

It has been found that a fast moving stream of gas when passing over a surface has a tendency to stratify with the strata adjacent the surface retaining its velocity longer than the layers further from the surface. The effect is, in the nozzle of this invention, that a layer of high velocity gaseous fuel sweeps across the inner surface of the shroud and keeps the shroud cool. The shroud is thus maintained cool enough to touch almost to the shroud outlet despite the fact that combustion is taking place within the shroud at a temperature in excess of 3000° F.

The stratas of gas in the nozzle lose velocity as they approach the nozzle outlet. The greatest loss of velocity is at the innermost layers as they pass over the base of the restrictor. Turbulance results at the base of the restrictor and it is in this zone that ignition is effected. Combustion will continue at the base of the restrictor providing a continuous "pilot flame" from which the gas stratas ignite as they lose velocity. The burning gases result in a concentration of very hot burnt gas which is located centrally within the shroud, the burnt gas is surrounded by a zone of burning gas (see FIG. 6). The thickness of the gaseous fuel stratas available for ignition reduces toward the shroud outlet due to the "burnt-through" of the fuel stratas. The length of the shroud is related to the distance from the point of ignition of the innermost layer of fuel to that of the outermost layer of fuel and in turn this is related to the velocity of the fuel passing through the gap and the speed of flame propagation. The arrangement is such that (in a preferred arrangement) the ignition of the outermost layer takes place as it reaches the shroud outlet. Thus the outlet edge of the shroud is exposed to flame and is heated to a termperature approximating that of the flame. Because of the cooling effect of the high velocity gas stratas passing over the shroud further upstream there is no transfer of heat from the hot outlet edge of the shroud back through the material from which the shroud is made.

Preferably all parts of the nozzle, the shroud and the restrictor are made from stainless steel and are very highly polished to enable the free unrestricted flow of gas over the surfaces. This promotes stratification by reducing surface friction with associated turbulance. The two wings 18 are also preferably made from highly polished stainless steel.

As a result of the operation as described above, and because of the pressure increase in the nozzle, there is a jet effect whereby flame and burnt gases pass from the nozzle outlet at high velocity whilst retaining a well defined shape for a distance of several inches from the nozzle outlet.

The relative sizing and positioning of the components is readily established by the formulae $$D = ALF/V_o$$

knowing $L$ = LINEAR DISTANCE (from the point of ignition of the innermost strata of gaseous fuel to the point where the outermost strata ignites). In this case chosen to be the shroud outlet.

$D$ = LINEAR DISTANCE (GAP) between the restrictor periphery and the adjacent shroud interior (assumed constant). (Also the thickness of the gaseous fuel stream at the assumed point of ignition of the innermost strata.)

$V_o$ = VOLUME of fuel passing through area $A$, chosen to suit nozzle heat output requirement.

$F$ = SPEED of flame propagation in gaseous fuel used.

$A$ = AREA of the gap of linear width $D$.

The formula is arrived at as follows. For a given nozzle performance choose $V_o$, $F$ is known, and L and the physical interior size of the shroud are chosen to suit requirements. The unknown is the size of the periphery of the restrictor and this determines the gap $D$.

Velocity of fuel through area $A = V_o/A$

Velocity also equals $= L/T$ (time)

Time $= D$ (gap width and thus fuel stream thickness) divided by $F$

Hence $$\text{VEL} = \frac{L}{T} = \frac{V_o}{A} = \frac{L}{\frac{D}{F}}$$

so $$V_o/A = LF/D$$

so $$D = ALF/V_o$$

The performance of one specific embodiment of the invention, with the nozzle designed to use LPG gas and mounted in a heat gun as shown in FIG. 1, is as follows. LPG gas is introduced through jet 6 having an orifice size of 0.035 inches and at a gas pressure of 45 pounds per square inch. This results in the fuel consumption of 5.25 pounds of LPG gas per hour. The air drawn into the venturi (through ports 7) as a result of the introduction of gas at the above rate is at a rate of 21.6 cubic feet per minute. The temperature of the flame within the nozzle is approximately 3000° F and the temperature at the nozzle outlet plus 18 inches is 650° F, plus 24 inches is 550° F, plus 30 inches is 440° F and plus 36 inches is 365° F. The heat output from the nozzle is approximately 110,000 BTU per hour. Using the formulae given above the dimensions of the various parts of the nozzle are as follows in order to achieve the above performance figures.

$L$ = 2.375 inches $D$ = 0.196 inch $V_o$ = 22.6 ft³/minute $F$ = 76 inches/sec.

$A$ = 0.5867 inch² = 1.3832 inches² (shroud interior area) minus 0.6975 inch² (area of the restrictor end).

I claim:

1. A nozzle in which combustion of gaseous fuel is to take place, said nozzle comprising a truncated hollow pyramidal shroud part and an interiorly coaxially mounted restrictor part, the shroud at its smaller end adapted to be coupled to a supply of pressurized gaseous fuel, said restrictor being generally pyramidal in shape with the apex of the pyramid directed toward the smaller end of said shroud and the base of the pyramid directed toward the other end of the shroud, the shape of the base of the pyramid and the internal cross-sectional shape of the shroud being similar with a gap between the perimeter of the pyramid base and the adjacent interior surface of the shroud through which a generally tubular stream of gaseous fuel passes, the linear value of gap $D$ being based on the use of fixed design criteria for the nozzle and calculated by the formula $$D = ALF/V_o$$

where $A$ is the area of gap of linear width $D$, $L$ is the length of travel of the gaseous fuel in the nozzle from the point of ignition of the innermost layer of gaseous fuel in the stream to the point where the outermost layer of gaseous fuel ignites, $F$ is the speed of flame propagation and $V_o$ is the volume of gaseous fuel per unit time passing through $A$.

2. A nozzle as claimed in claim 1 wherein said shroud and said restrictor are of circular cross-section.

3. A nozzle as claimed in claim 1 wherein the restrictor is hollow and open at its base.

4. A nozzle as claimed in claim 1 including an igniting opening positioned to open into the nozzle adjacent the base of the restrictor.

5. A nozzle as claimed in claim 1 including a mixing and accelerating means for gas and air.

* * * * *